United States Patent [19]

Hanna

[11] Patent Number: 4,887,816

[45] Date of Patent: Dec. 19, 1989

[54] LOTTERY APPARATUS

[75] Inventor: George Hanna, Forest Hills, N.Y.

[73] Assignee: H & Y Enterprises, Forest Hills, N.Y.

[21] Appl. No.: 326,919

[22] Filed: Mar. 22, 1989

[51] Int. Cl.[4] ..... A63F 9/00

[52] U.S. Cl. ..... 273/144 A

[58] Field of Search ..... 273/144 R, 144 A, 144 B, 273/29 R, 29 A, 26 B

[56] References Cited

U.S. PATENT DOCUMENTS

| | | | |
|---|---|---|---|
| 2,490,144 | 12/1949 | Masten | 273/144 A |
| 4,025,071 | 5/1977 | Hodges | 273/29 A |
| 4,834,385 | 5/1989 | Jackson | 273/144 A |

*Primary Examiner*—Edward M. Coven
*Assistant Examiner*—David G. Ward
*Attorney, Agent, or Firm*—Thomas H. Whaley

[57] ABSTRACT

A lottery apparatus comprising a receptacle from which lottery balls can pass into a mixing chamber. A screw conveyor in the form of a rotatable tube with an internal helical baffle extends horizontally from the mixing chamber to a discharge chamber. The end of the screw conveyor in the mixing chamber has a scoop attached thereto which serves to agitate the lottery balls in the mixing chamber and to feed one ball to the conveyor with each rotation of the conveyor. The rotatable tube is transparent so that progress of each lottery ball therethrough can be watched. Clear plastics are preferred materials for most apparatus parts. A manual crank or an electric motor is used to rotate the screw conveyor.

11 Claims, 2 Drawing Sheets

LOTTERY APPARATUS

BACKGROUND OF THE INVENTION

This invention relates to a lottery apparatus in which a plurality of uniform balls with varied indicia are mixed and from which the balls are randomly discharged one at a time.

Numerous devices have been proposed for conducting lottery games but none has gained a broad market. Perhaps, prior devices have failed to be broadly popular because they lacked attractiveness and their operation did not stimulate interest and excitement while each ball was randomly withdrawn from the agitated mass of balls used in the lottery.

A principal object of this invention is to provide an apparatus for conducting lottery games which draws and holds the attention of players while the balls are being mixed and randomly discharged one at a time.

Another important object is to provide a lottery apparatus that is visually attractive and that highlights the truly random discharge of individual balls.

Those and other features and advantages of the invention will be evident from the description which follows.

SUMMARY OF THE INVENTION

In accordance with this invention, a lottery apparatus comprises a ball rack positioned to drop a multiplicity of uniform balls therefrom into a mixing chamber when a door between the rack and mixing chamber is opened, a rotatable tubular passage extending substantially horizontally from the mixing chamber to a discharge chamber, a helical baffle within the tubular passage, a scoop affixed radially at the end of the tubular passage positioned in the mixing chamber, a gravity gate between the scoop and the rotatable passage which functions to admit a single ball from the mixing chamber to the tubular passage with each rotation thereof, and rotary drive means connected to rotate the tubular passage with the internal helical baffle.

As the tubular passage is rotated, the scoop projecting radially therefrom passes through the mass of balls in the mixing chamber and causes simultaneous mixing of the balls and lifting of at least one of those balls. A gate where the scoop communicates with the tubular passage stops that communication while two or more balls are in the scoop. However, as the scoop is rotated all but one of the balls fall out and thereupon the gate swings open by gravity to admit the remaining single ball to the tubular passage. Rotation of the tubular passage with its internal helical baffle advances that ball toward the discharge chamber until the ball falls therein. Thus, the rotatable tubular passage with the internal helical baffle is a screw conveyor for each ball randomly lifted by the scoop from the mixing chamber, transporting the ball until it drops into the discharge chamber.

Inasmuch as the lottery apparatus of this invention is designed to hold the attention of players while the balls are randomly picked, the tubular passage is made of a transparent material, glass or plastic, so that the movement of each picked ball toward the discharge chamber can be watched. Preferably, the mixing and discharge chambers and the ball rack are also transparent so that the progress of the lottery balls can be followed from the rack to the discharge chamber. Clear plastics are materials of choice because of cost, ease of fabrication and resistance to breakage.

At least the lower portion of the mixing chamber is substantially semi-cylindrical with a radius slightly greater than the radial length of the scoop which freely sweeps over the surface of the curved bottom of the mixing chamber when the tubular passage is rotated.

While the ball rack above the mixing chamber may have any desired shape such as a funnel or chute, several parallel clear tubes, each having an inside diameter slightly greater than the diameter of the lottery balls and having a length to hold a stack of balls, form a preferred ball rack because it facilitates inspection of all the balls before the lottery apparatus is activated.

The door between the ball rack and mixing chamber is simply provided by a slide plate that may be moved to allow the balls to drop into the mixing chamber. Other forms of door include rotary dampers and hinged plates.

The discharge chamber can take any shape that will act as a receptacle for the balls advanced by the screw conveyor, i.e., the rotatable tubular passage with its internal helical baffle, from its inlet end to its exit end. While a box, bowl or pan can function as the discharge chamber, a transparent, short cylinder positioned with its axis coinciding with the axis of the screw conveyor provides a preferred discharge chamber for the lottery balls leaving the screw conveyor.

The exit end of the screw conveyor preferably has a discharge tube angularly positioned relative to the axis of rotation of the screw conveyor. This discharge tube has an inside diameter greater than the diameter of the lottery balls. A ball that has been advanced by the helical baffle with the rotation of the tubular passage to its exit end cannot drop into the discharge chamber until rotation swings the discharge tube so that its free end begins to point downwardly.

The rotary drive means may be a simple crank for manual rotation of the screw conveyor or it may be an electric motor powered by battery or house current.

BRIEF DESCRIPTION OF THE DRAWINGS

For a fuller understanding of the invention, the description which follows will refer to the appended drawings of which.

DESCRIPTION OF A PREFERRED EMBODIMENT

Figure 1:
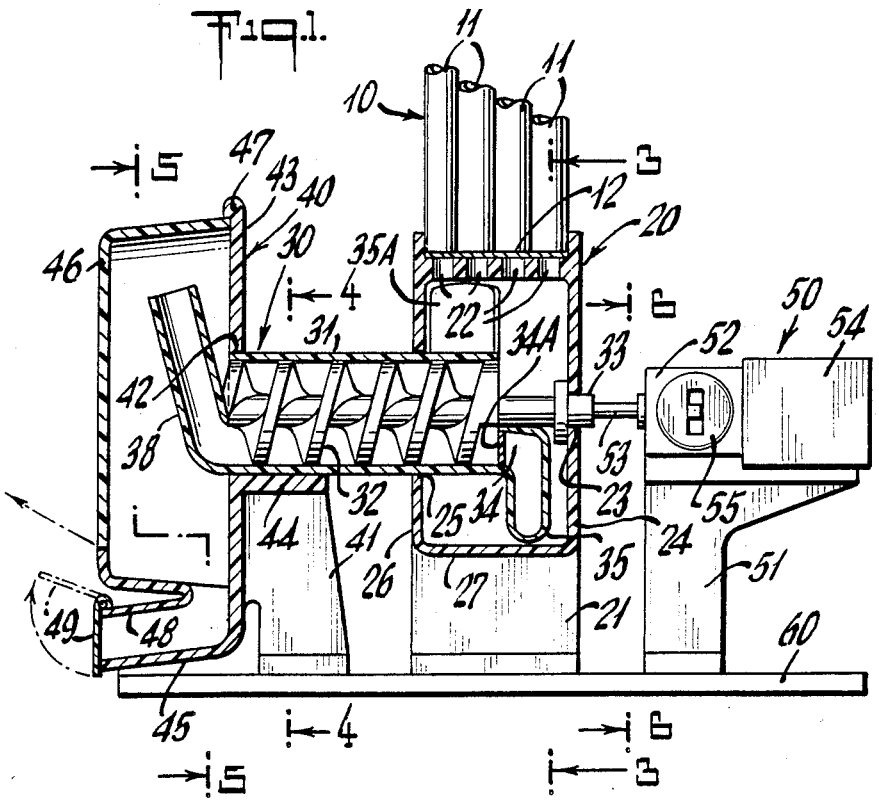
FIG. 1 is a vertical section of a preferred embodiment of the lottery apparatus, taken along the line 1—1 of FIG. 2.
Figure 2:
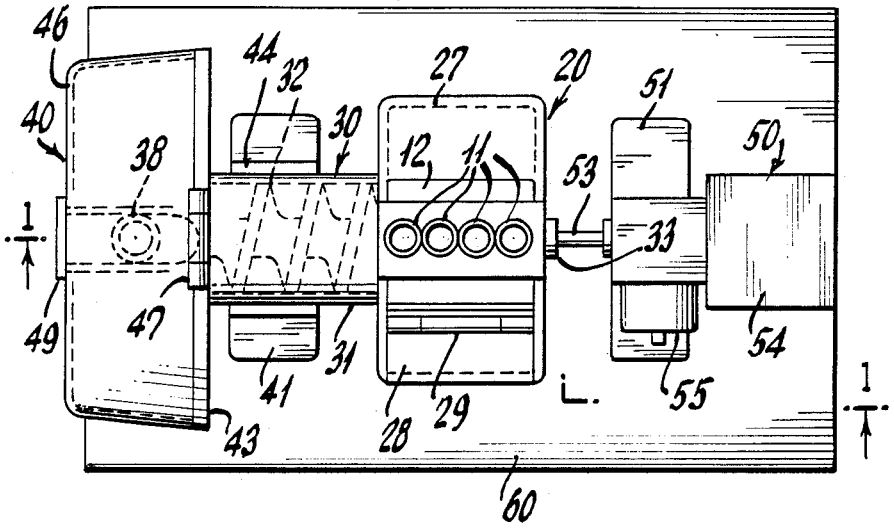
FIG. 2 is a top view of the lottery apparatus of FIG. 1.

The lottery apparatus of FIGS. 1–6 comprises the basic components of a ball rack 10, mixing chamber 20, screw conveyor 30, discharge chamber 40 and rotary drive means 50. Mixing chamber 20 has pedestal 21 mounted on base plate 60; discharge chamber 40 is attached by pedestal 41 to plate 60; and rotary drive means 50 is held by pedestal 51 on plate 60.

Ball rack 10 has four vertically parallel tubes 11 mounted on top of mixing chamber 20. Tubes 11 are contiguous to one another and are of a diameter and length adequate to hold all of the balls used in the lottery. The top portion of mixing chamber 20 has four apertures 22 aligned with the bottom ends of tubes 11. Slide plate 12 is transversely positioned between the bottoms of tubes 11 and apertures 22 and acts as a door permitting the entry of the lottery balls into mixing chamber 20 when slide plate 12 is retracted.

Figure 3:
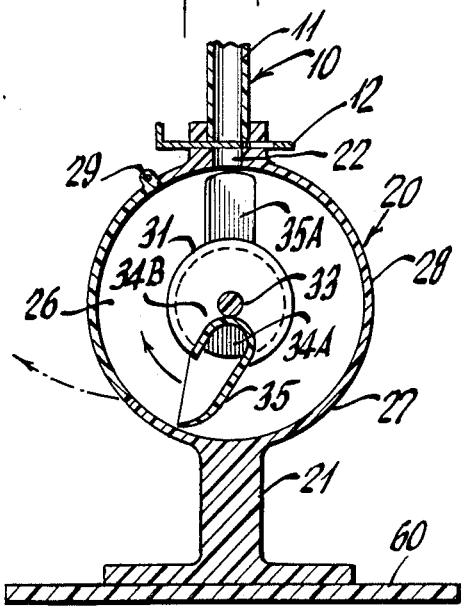
FIG. 3 is a transverse section through the mixing chamber of the lottery apparatus of FIG. 1, taken along the line 3—3.
Figure 4:
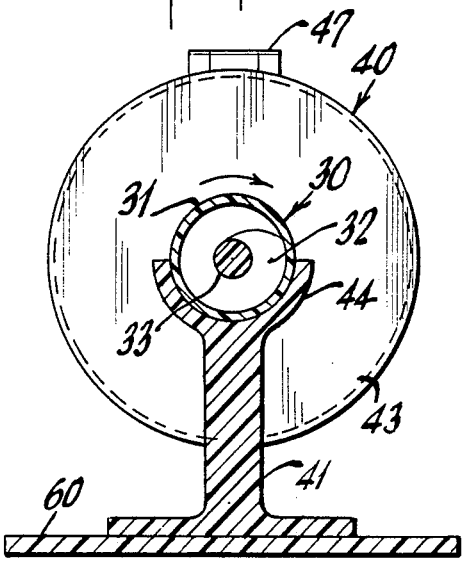
FIG. 4 is a transverse section through the screw conveyor of the lottery apparatus of FIG. 1, taken along the line 4—4.
Figure 5:
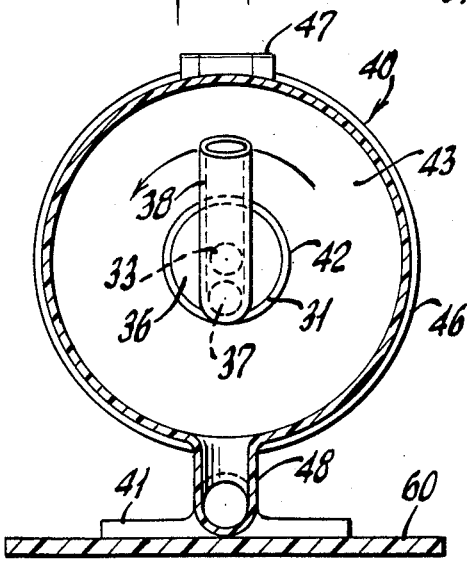
FIG. 5 is a transverse section through the discharge chamber of the lottery apparatus of FIG. 1, taken along the line 5—5.

Screw conveyor 30 is provided by tube 31 and internal helical baffle 32 which has axial rod 33 extending through aperture 23 in wall 24 of chamber 20. Tube 31 is rotatably set in aperture 25 in wall 26 of chamber 20. The end of tube 31 within chamber 20 is closed except for aperture 34 for the entry of a lottery ball. Attached to tube 31 and communicating with aperture 34 is scoop 35 which extends radially from axial rod 33 to the cylindrical wall 27 of chamber 20 without making rubbing contact therewith. The mouth of scoop 35 passes through the mass of balls in mixing chamber 20. Preferably, the agitation of the balls caused by the passage of scoop 35 through the mass of balls in chamber 20 is enhanced by providing at least one blade or paddle 35A attached radially to tube 31. FIGS. 1 and 3 show a single paddle 35A positioned diametrically opposite scoop 35.

Figure 3A:
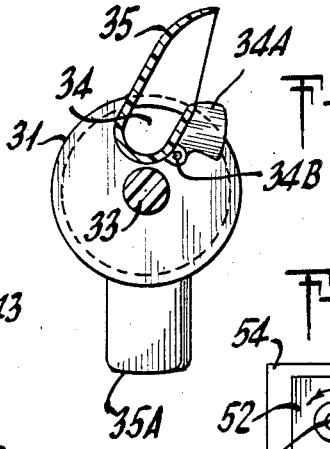
FIG. 3A shows only the screw conveyor of FIG. 3 when rotated 180° from the position shown in FIG. 3.
Figure 6:
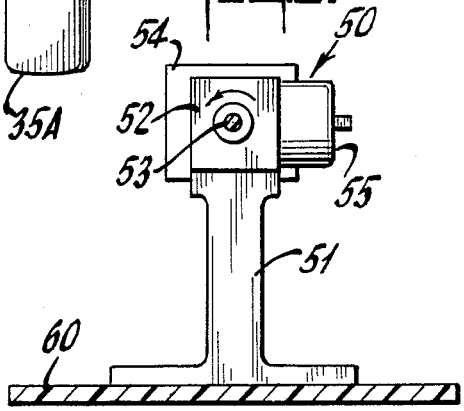
FIG. 6 is a transverse section through the drive shaft showing the electrical drive housing of the lottery apparatus of FIG. 1, taken along the line 6—6.

A shutter or gate 34A has a pivot hinge 34B on the closed end of tube 31 adjacent scoop 35 so that when scoop 35 is at its lowest point in FIG. 3 gate 34A hangs across and seals aperture 34. However, when tube 31 rotates to the position shown in FIG. 3A only one ball remains in scoop 35 and gate 34A swings away from aperture 34 so that the ball enters tube 31. The width of scoop 35 and the diameter of aperture 34 are slightly greater than the diameter of the lottery balls.

The other end 36 of tube 31 passes through aperture 42 in wall 43 of discharge chamber 40. End 36 of tube 31 is rotatably supported by semi-cylindrical bearing 44 which is part of pedestal 41. End 36 of tube 31 is closed except for aperture 37 which communicates with tube 38 angularly connected to end 36 and extending diametrically across end 36. Preferably as shown, the free ends of scoop 35 and tube 38 for the discharge of lottery balls are in approximately diametrically opposite positions so that a ball reaching end 36 of screw conveyor 30 cannot drop into discharge chamber 40 while scoop 35 is lifting another ball from mixing chamber 20.

Chamber 40 is formed by vertical wall 43 which has a slanted bottom portion 45, and by pan-shaped element 46 that is attached to the top of wall 43 by hinge 47. The bottom portion of pan-shaped element 46 includes spout 48 with hinged cover 49 at its end. Hinged cover 49 is lifted to remove lottery balls that have dropped into discharge chamber 40, while pan-shaped element 46 can be swung up on hinge 47 to gain access into chamber 40 for internal cleaning.

Similarly, cylindrical wall 27 of mixing chamber 20 has a cutout 28 held to wall 27 by hinge 29. By swinging hinged cutout 28 upwardly, the balls remaining in chamber 20 can be withdrawn after the winning lottery balls have been withdrawn from chamber 40.

Rotary drive means 50 comprises electric motor 52 with shaft 53 connected to axial rod 33 of screw conveyor 30, housing 54 for electric batteries (not shown), and off-on switch 55 that controls motor 52. The rotation of motor 52 is selected in relation to helical baffle 32 to cause a lottery ball picked up by scoop 35 from mixing chamber 20 to be pushed toward delivery tube 38. In the embodiment of the lottery apparatus of FIGS. 1–6, that rotation is clockwise as viewed in FIGS. 3 and 4. Of course, if helical baffle 32 had a twist opposite to that shown in FIG. 1, the rotation of electric motor 52 would be reversed so that rotation would be counterclockwise as viewed in FIGS. 3 and 4. In such case, scoop 35 would have its open end facing toward the right in FIG. 3.

Variations and modifications of the invention will be apparent to those skilled in the art without departing from the spirit and scope of the invention. For example, an electric motor that operates on house current may be substituted for the battery-powered motor 52 of FIGS. 1 and 2. Discharge tube 38 may be omitted. Chamber 40 comprising wall 43 and pan-shaped element 46 may be replaced by a bowl positioned to catch the lottery balls discharged through tube 38. Accordingly, only such limitations should be imposed on the invention as are set forth in the appended claims.

I claim:

1. A lottery apparatus for randomly picking lottery balls of uniform size from a mixed mass of said balls, which comprises a mixing chamber having at least a semi-cylindrical lower portion, a screw conveyor for said balls formed by a rotatable transparent tube with an internal helical baffle disposed substantially horizontally and extending from said mixing chamber to a discharge chamber for said balls, a scoop radially attached to the end of said tube within said mixing chamber, said scoop providing a channel for bringing a single ball to an entry aperture in the end of said screw conveyor, and rotary drive means connected to rotate said screw conveyor together with said scoop so that each time said scoop sweeps upwardly from said semi-cylindrical lower portion of said mixing chamber said balls therein are randomly mixed and a single ball is caused to enter said screw conveyor.

2. The lottery apparatus of claim 1 including a pivotally hinged gate that hangs across said aperture when said scoop is at its lowest rotational position and that swings away from said aperture when said scoop is at its highest rotational position.

3. The lottery apparatus of claim 1 wherein the mixing chamber, the discharge chamber and the screw conveyor are supported by pedestals mounted on a single base plate.

4. The lottery apparatus of claim 3 wherein the discharge chamber is substantially cylindrical and is supported with its axis horizontal by a pedestal which also has a semi-cylindrical bearing for the support of the screw conveyor.

5. The lottery apparatus of claim 1 including a receptacle comprising contiguous vertical tubes mounted above said mixing chamber each adapted for holding a stack of lottery balls, and means for selectively opening each of said tubes to said mixing chamber.

6. The lottery apparatus of claim 1 wherein the mixing chamber and the discharge chamber are transparent, and the discharge end of the screw conveyor has a transparent discharge tube for a lottery ball connected diametrically across said discharge end of said screw conveyor, the free ends of said discharge tube and the scoop being in substantially diametrically opposite positions.

7. The lottery apparatus of claim 1 wherein the rotary drive means is an electric motor.

8. The lottery apparatus of claim 1 wherein a paddle positioned within the mixing chamber is attached for rotation with the screw conveyor.

9. The lottery apparatus of claim 8 wherein at least one paddle positioned within the mixing chamber is attached radially to the tube of the screw conveyor.

10. The lottery apparatus of claim 9 wherein the mixing chamber is substantially cylindrical and transparent, the rack is formed by contiguous vertical tubes which are transparent and can individually hold a stack of lottery balls, and the rotary drive means is an electric motor.

11. A lottery apparatus for randomly picking lottery balls of uniform size from a mixed mass of said balls, which comprises a receptacle for holding said balls, a mixing chamber having at least a semi-cylindrical lower portion, said receptacle and said mixing chamber having aligned apertures for the passage of said balls from said receptacle to said mixing chamber, a control door between said aligned apertures, a screw conveyor for said balls formed by a rotatable transparent tube with an internal helical baffle disposed substantially horizontally and extending from said mixing chamber to a discharge chamber for said balls, a scoop radially attached to the end of said tube within said mixing chamber, said scoop providing a channel for bringing a single ball to an entry aperture in the end of said screw conveyor, a pivotally hinged gate that hangs across said aperture when said scoop is at its lowest rotational position and that swings away from said aperture when said scoop is at its highest rotational position, and rotary drive means connected to rotate said screw conveyor together with said scoop so that each time said scoop sweeps upwardly from said semi-cylindrical lower portion of said mixing chamber said balls therein are randomly mixed and a single ball is caused to enter said screw conveyor.

* * * * *